US006176409B1

(12) United States Patent
Lee

(10) Patent No.: US 6,176,409 B1
(45) **Date of Patent: *Jan. 23, 2001**

(54) ADHESIVE TAPE DISPENSER

(76) Inventor: Sang-chul Lee, 707-1403, Jugong Apt., Haan-dong 295, Kwangmyong-shi (KR), 423-060

( * ) Notice: Under 35 U.S.C. 154(b), the term of this patent shall be extended for 0 days.

This patent is subject to a terminal disclaimer.

(21) Appl. No.: 09/247,944

(22) Filed: Feb. 11, 1999

(30) Foreign Application Priority Data

Feb. 11, 1998 (KR) ..... 98-3921

(51) Int. Cl.[7] ..... B23D 25/00; B26F 3/02; B32B 31/00; B44C 7/00

(52) U.S. Cl. ..... 225/16; 83/436.5; 83/649; 225/11; 225/14; 225/15; 156/527; 156/577; 156/579; 156/574; 156/523; 156/510

(58) Field of Search ..... 225/10, 11, 14, 225/15, 16; 83/649, 436.5; 156/527, 577, 579, 574, 523, 510

(56) References Cited

U.S. PATENT DOCUMENTS

| | | | | |
|---|---|---|---|---|
| 2,652,115 | * | 9/1953 | Mysels | 225/16 X |
| 2,822,046 | * | 2/1958 | Krueger | 225/11 X |
| 3,035,345 | * | 5/1962 | Barnard | 225/14 X |
| 3,050,853 | * | 8/1962 | Domeny | 83/649 X |
| 3,194,463 | * | 7/1965 | Comet | 225/16 X |
| 3,386,634 | * | 6/1968 | Curry | 83/649 X |
| 4,262,835 | * | 4/1981 | Wrobel | 225/15 X |
| 4,630,765 | * | 12/1986 | Samuelson et al. | 83/649 X |
| 5,482,182 | | 1/1996 | Thompson et al. | 221/73 |
| 5,776,301 | | 7/1998 | Huang | 156/577 |
| 5,820,725 | | 10/1998 | Maeda | 156/391 |
| 5,878,932 | | 3/1999 | Huang | 225/65 |

FOREIGN PATENT DOCUMENTS 98-058106 * 9/1998 (KR) .

OTHER PUBLICATIONS

Application Serial Number 09/222,131, Lee, "Automatic Drawing and Cutting Device For Adhesive Tape Dispenser", Claims 1–4, Dec. 1998.*

* cited by examiner

*Primary Examiner*—S. Thomas Hughes
*Assistant Examiner*—Marc Jimenez
(74) *Attorney, Agent, or Firm*—Reed Smith Hazel & Thomas LLP

(57) ABSTRACT

The present invention relates to an adhesive tape dispenser which includes a gun-shaped case body having a detachable cover, a drawing portion for drawing an adhesive tape from the case body, and having a trigger handle protruded outwardly from one side of the case body and a pair of drums rotating with the trigger handle, and a cutting portion for cutting the adhesive tape which is drawn by the drawing portion from the dispenser, and having a handling member mounted on a gunbarrel portion of the case body, a lever interlocking with the handling member and a cutter mounted at a front end of the lever, so that an user may draw the adhesive tape as long as necessary by pulling the trigger handle without pulling it with hand, an adhesive strength of the adhesive tape is kept in good state, and an adhesion state of the adhesive tape is clean, since the adhesive tape is cut clean by a cutter.

6 Claims, 9 Drawing Sheets

ADHESIVE TAPE DISPENSER

BACKGROUND OF THE INVENTION

The present invention relates to an adhesive tape dispenser which is widely used as stationery, and more particularly, to an adhesive tape dispenser which has an automatic drawing and cutting means, so that an user may use an adhesive tape conveniently.

DESCRIPTION OF THE PRIOR ART

In general, adhesive tape dispensers have an opening at one side thereof through which an adhesive tape is detachably mounted. Most of the conventional adhesive tape dispensers have a saw toothed cutting blade which is integrally formed or detachably located at a front end part thereof so that a free end part of the adhesive tape is drawn from the tape dispenser and cut by the saw toothed cutting blade. After cutting, the free end part of the adhesive tape is attached on a shoulder part formed under the saw toothed cutting blade for next use.

Therefore, if users want to use the adhesive tape in the conventional adhesive tape dispenser, they have to detach the adhesive tape attached on the shoulder part of the tape dispenser with finger, pull it as long as necessary, put it on the saw toothed cutting blade and strain downward so that the adhesive tape can be cut. However, all of these procedure should be taken manually and inconveniently, and an adhesive strength of the adhesive tape is weakened by fingerprints or dirt, since the users grasp the adhesive tape with finger during using it.

SUMMARY OF THE INVENTION

An object of the present invention is to provide an adhesive tape dispenser having an automatic drawing and cutting means which may automatically draw out the adhesive tape as long as necessary without pulling it with hand and automatically cut it clean by a cutter, so that the user may use the adhesive tape conveniently.

To achieve the object the adhesive tape dispenser according to the present invention includes a gun-shaped case body having a detachable cover, a drawing means for drawing an adhesive tape from the case body, and having a trigger handle protruded outwardly from one side of the case body and a pair of drums rotating in integration with the trigger handle, and a cutting means for cutting the adhesive tape which is drawn by the drawing means from the dispenser, and having a handling member mounted on a gunbarrel portion of the case body, a lever interlocking with the handling member and a cutter mounted at a front end of the lever.

The adhesive tape dispenser according to the present invention may draw the adhesive tape from the case body as long as necessary by putting a finger on the trigger handle and pulling the handle several times without directly pulling the adhesive tape with hand, and may cut clean the drawn adhesive tape by the cutter when the user pulls the handling member.

BRIEF DESCRIPTION OF THE DRAWINGS

Embodiments of the invention will now be described by way of example with reference to the accompanying drawing, in which.

DETAILED DESCRIPTION OF THE PREFERRED EMBODIMENT

Figure 1:
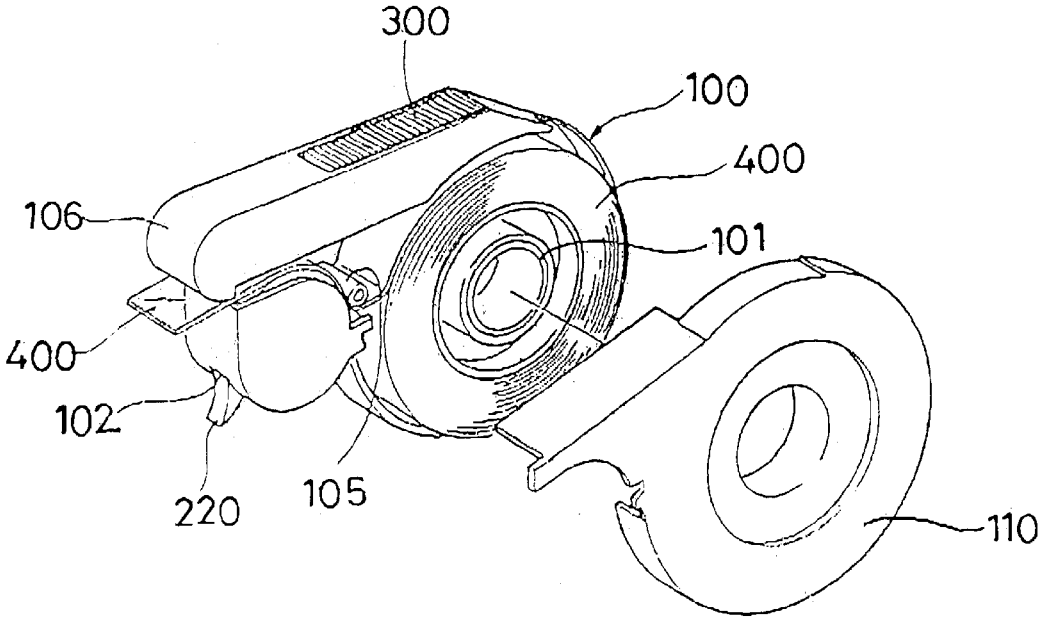
FIG. 1 is a perspective view showing a separated state of an adhesive tape dispenser and according to the present invention.
Figure 2:
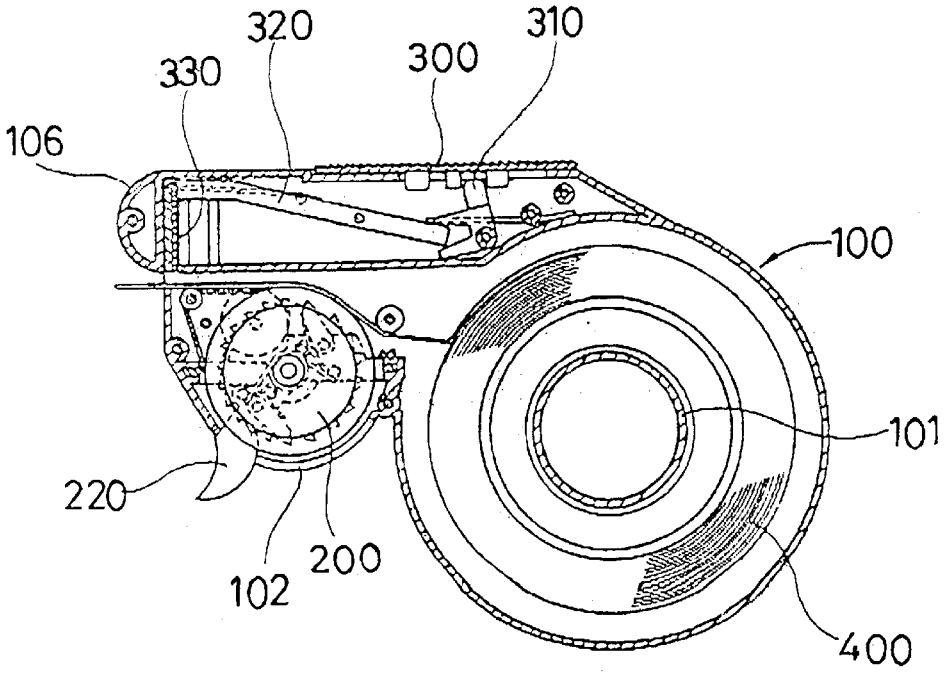
FIG.2 is a partial cross-sectional view showing an installation state of a drawing and a cutting means in the adhesive tape dispenser according to the present invention.

FIG. 1 is a perspective view showing a separated state of an adhesive tape dispenser and a cover according to the present invention, and FIG. 2 is a partial cross-sectional view showing an installation state of a drawing means and a cutting means in the adhesive tape dispenser according to the present invention.

As shown in FIG. 1 and FIG. 2, an adhesive tape dispenser according to the present invention includes a gun-shaped case body 100 having a detachable cover 110 and a protrusion 101 for detachably mounting an adhesive tape 400; a drawing means for drawing the adhesive tape 400 from the case body 100, and having a trigger handle 220 protruded outwardly through an opening 102 at one side of the case body 100, a pair of drums 200 rotating in integration with the trigger handle 220; and a cutting means for cutting the adhesive tape 400 which is drawn by the drawing means from the case body 100, and having a handling member 300 mounted on a gunbarrel portion of the case body 100, a lever 320 interlocking with the handling member 300 and a cutter 330 mounted at a front end of the lever 320.

Figure 3:
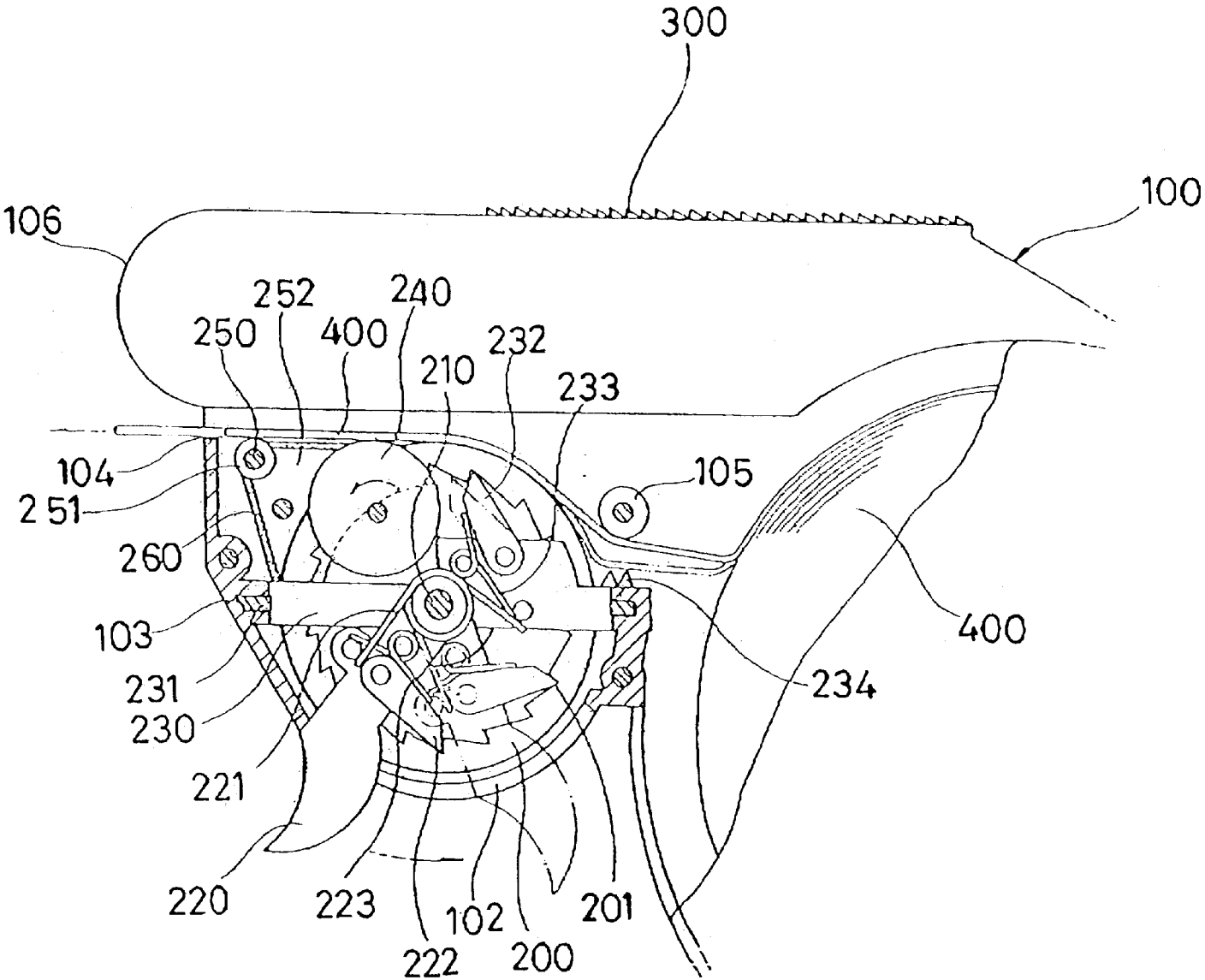
FIG. 3 is a partial construction view of the drawing means separately taken from the adhesive dispenser according to present invention.

As shown in FIG. 2 and FIG. 3, the drawing means having the trigger handle 220 and the drums 200 are mounted at a front part of the protrusion 101 of the case body 100.

Figure 4A:
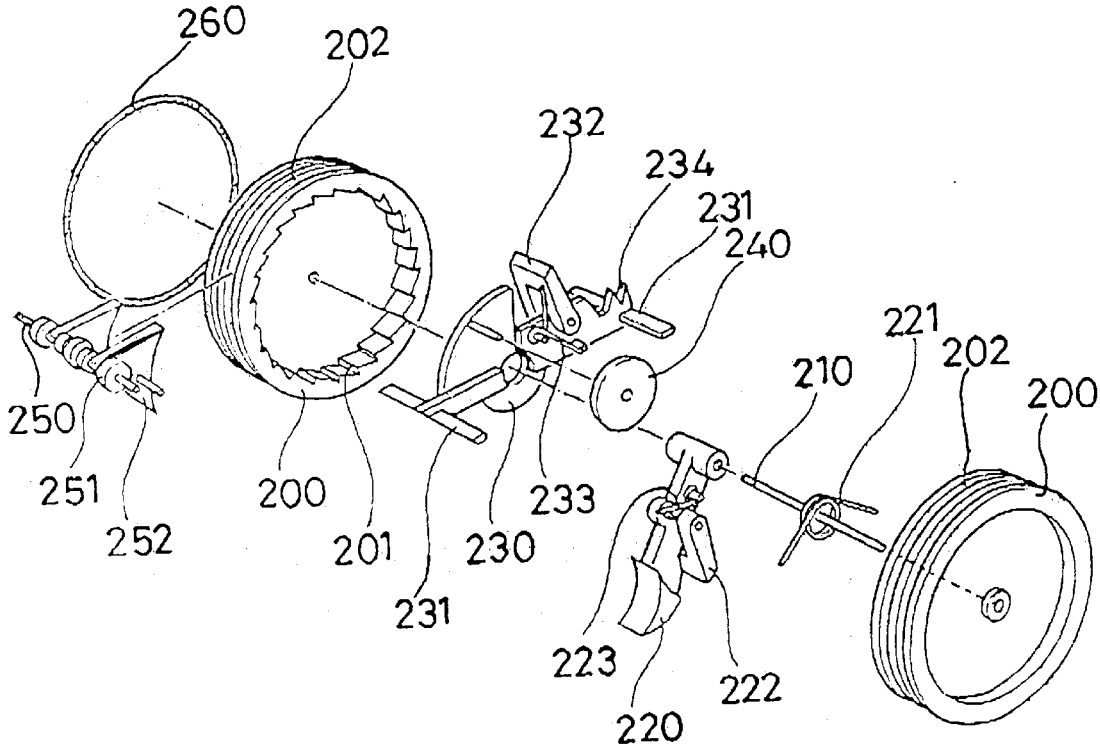
FIG. 4*a* is an exploded perspective view of the drawing means according to the present invention.
Figure 4B:
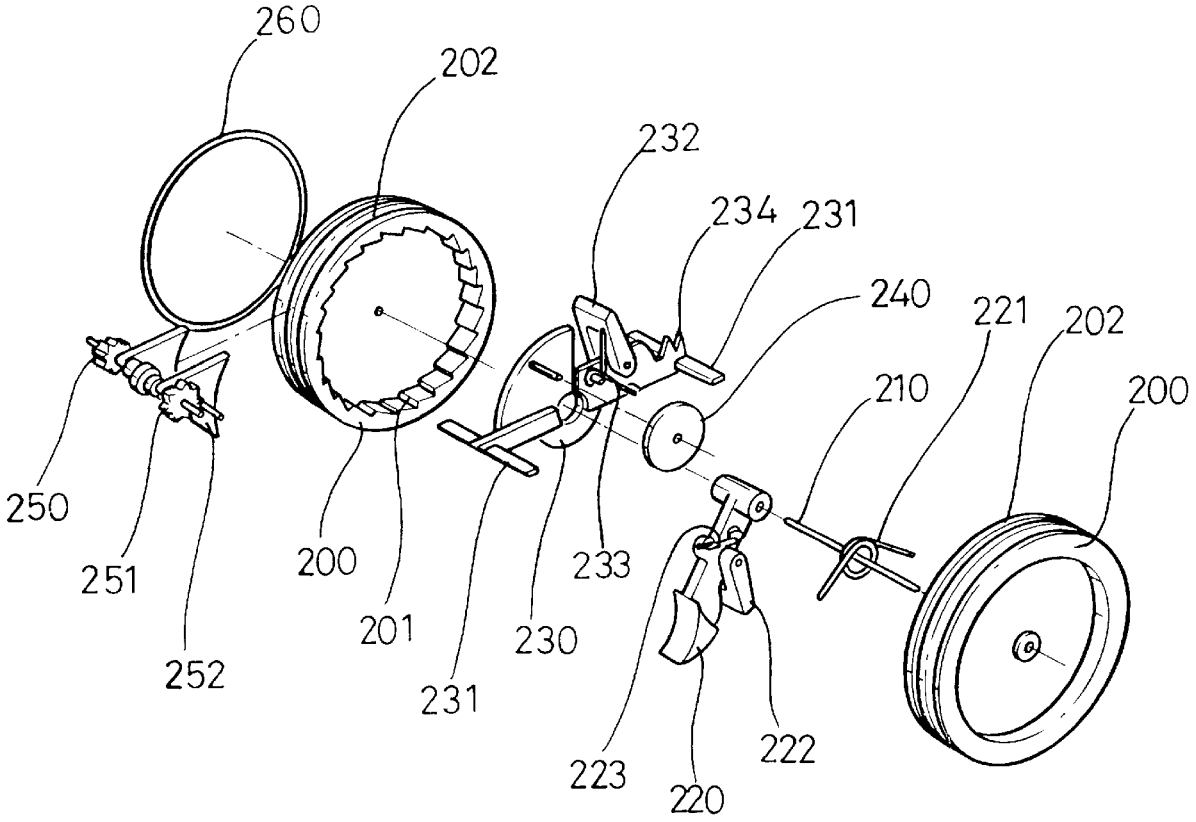
FIG. 4*b* is an exploded perspective view of the drawing means with the auxiliary rollers formed as a gear type.
Figure 5:
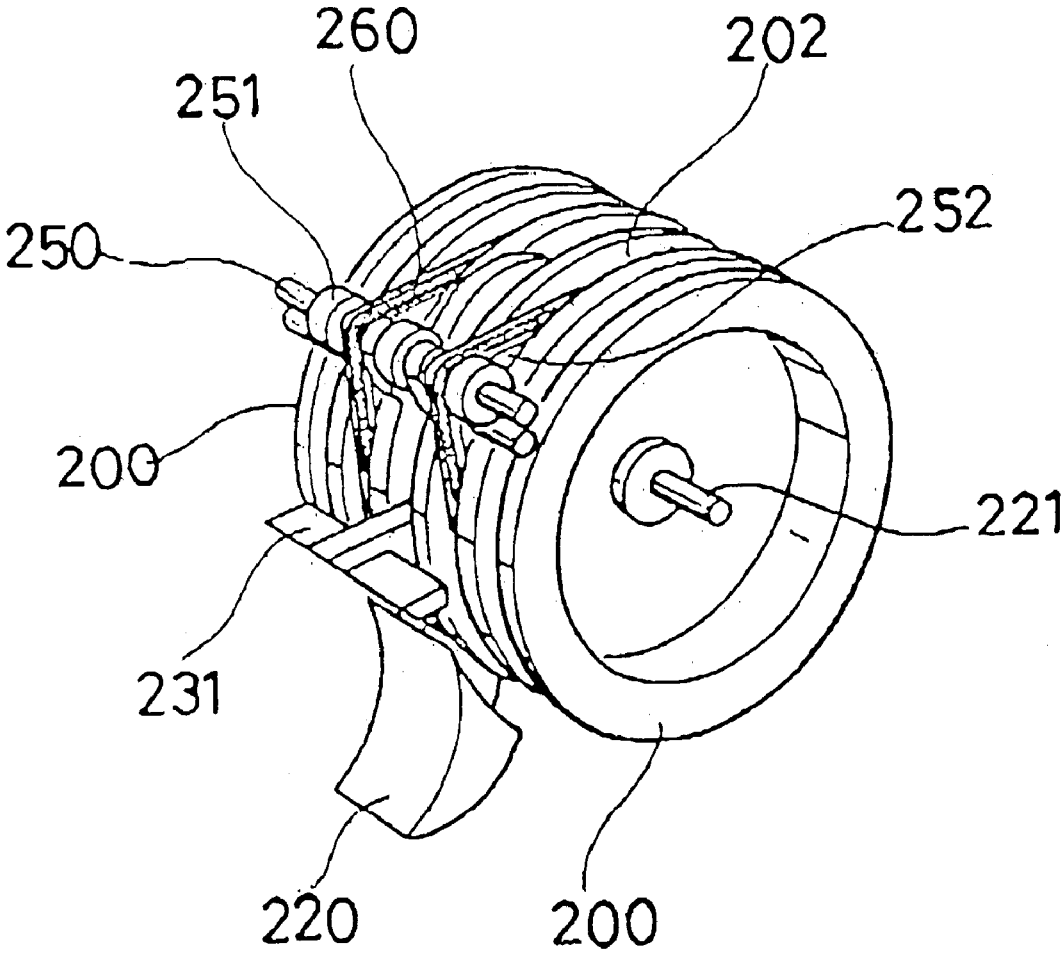
FIG. 5 is a perspective view showing the assembled state of the drawing means according to the present invention, as shown in FIG. 4.

FIG. 4 is an exploded perspective view of the drawing means according to the present invention, and FIG. 5 is a perspective view showing the assembled state of the drawing means according to the present invention, as shown in FIG. 4.

Referring to FIG. 4 and FIG. 5, the construction of the drawing means according to the present invention is explained in more detail as follows.

The trigger handle 220 has a push latch 222 supported by a second spring 223 and mounted by a pin. The drawing means further includes a supporting portion 230 having a pair of insertion portions 231 which is located at side ends of the supporting portion 230, exposed outside the drums 200 and fixedly inserted in a pair of grooves 103 at sides of the case body 100, and a holding latch 232 supported by a third spring 233 and mounted by a pin in opposing direction to the push latch 222, a roller 240 mounted at a front end of an upper part of the supporting portion 230 by a pin to idle, and a shaft pin 210 for inserting the trigger handle 220 and the supporting portion 230. The trigger handle 220 is rotatably inserted in the shaft pin 210 and supported on the supporting portion 230 by a first spring 221 inserted in the shaft pin 210.

Between the drums 200 and the adhesive tape 400 inserted in the protrusion 101, a guide bar 105 for guiding the adhesive tape 400 is mounted so that the adhesive surface of the adhesive tape may contact smoothly on a peripheral surface of the drums 200. In case that the adhesive tape 400 is drawn out while a diameter of the adhesive tape 400 becomes smaller and smaller, a saw-toothed protrusion 234 of the supporting portion 230 prevents the adhesive surface of the adhesive tape 400 from contacting to the rear part of the insertion portion 231 of the supporting portion 230.

On inner peripheries of the drums 200 which are rotatably inserted at each of ends of the shaft pin 210, a multistage latch 201 is formed to contact and catch the front end parts of the holding latch 232 and the push latch 22. On outer peripheries of the drums 200, grooves 202 for belts is formed. A shaft 250 which has auxiliary rollers 251 inserted therein and which is away from the drums 200 by an interval keeping means 252 at certain intervals is coupled with the drum 200 by the belts 260 in order to be rotated with the drum 200.

It is preferable that outer peripheries of the auxiliary rollers 251 are formed as a gear type to a contact area of the adhesive surface of the adhesive tape 400, thus smoothly drawing the adhesive tape 400.

Figure 6A:
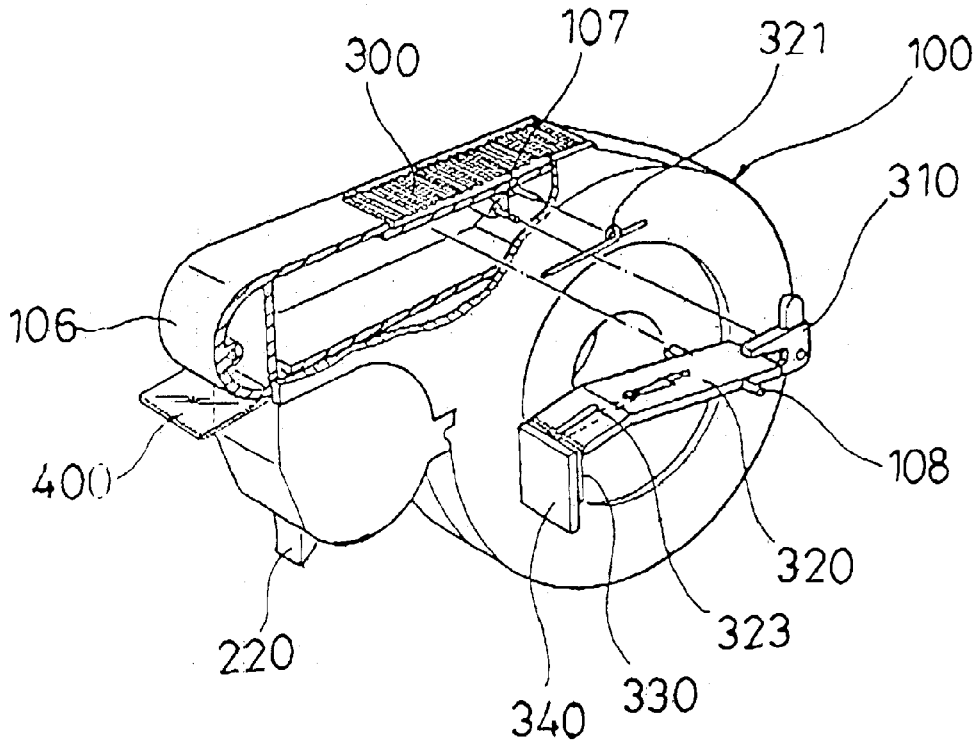
FIG. 6*a* is a perspective view showing the cutting means.
Figure 6B:
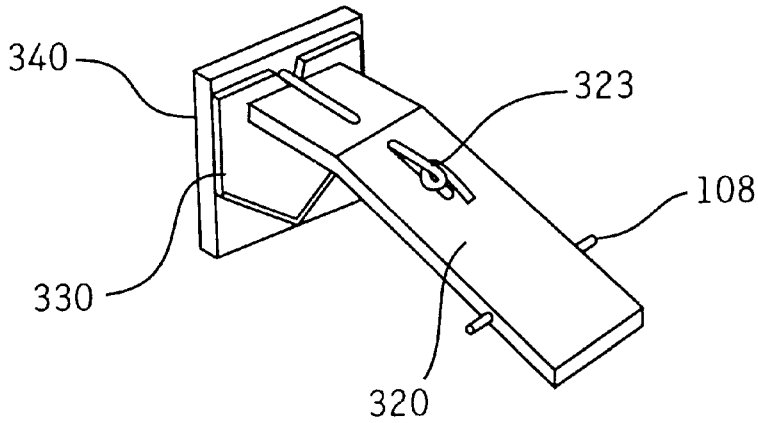
FIG. 6*b* is a perspective view of the cutting means separated from the adhesive tape dispenser according to the present invention.
Figure 7:
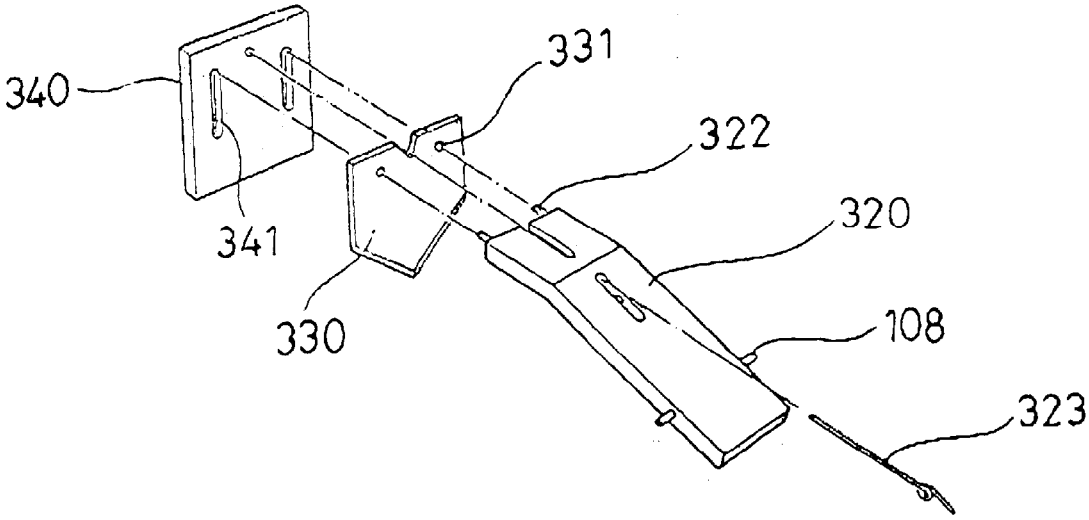
FIG. 7 is a perspective view showing a disassembly of the cutting means according to the present invention.
Figure 8A:
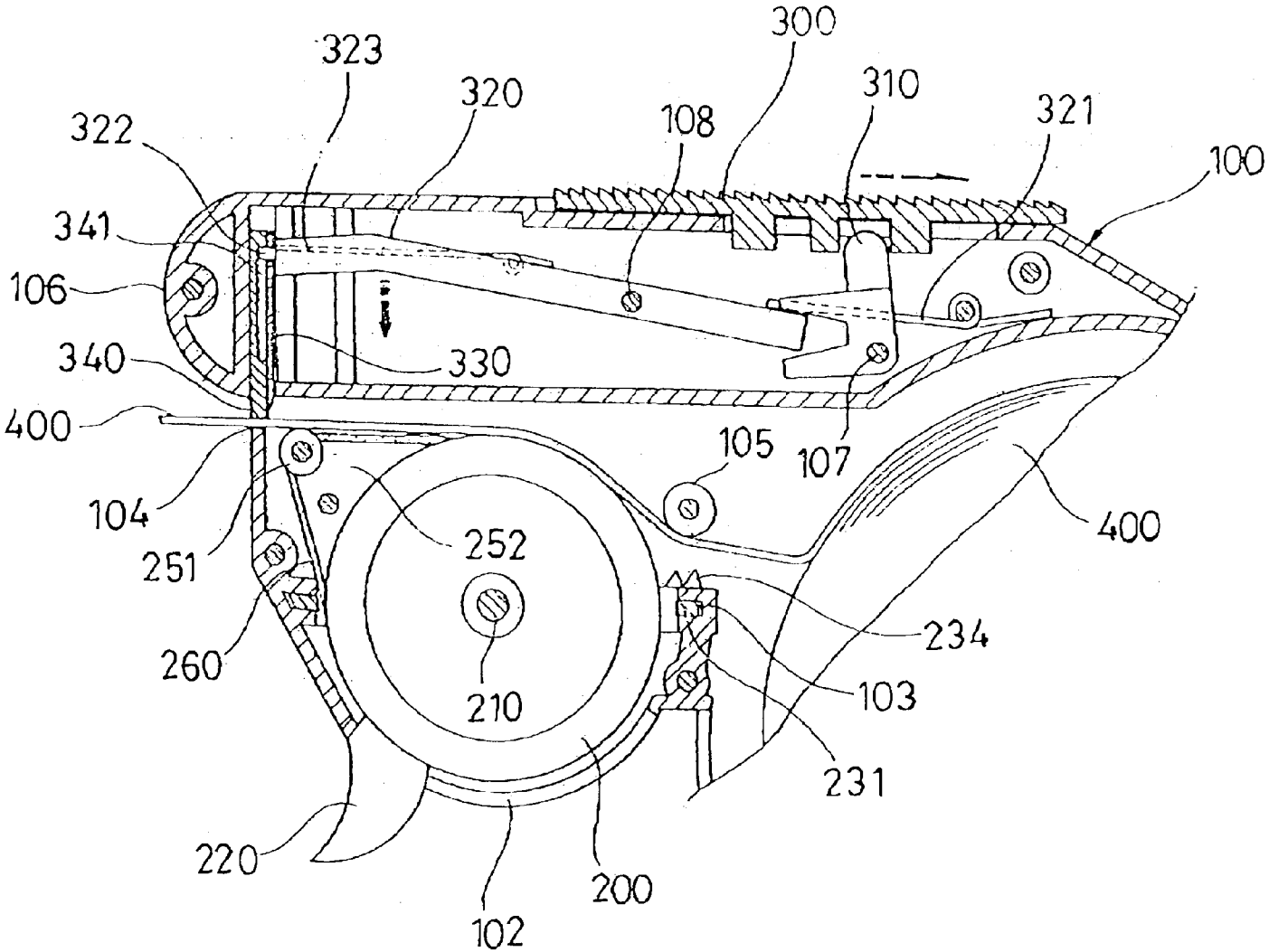
FIG. 8*a* and FIG. 8*b* are explanation views of the operation principal of the cutting means according to the present invention.
Figure 8B:
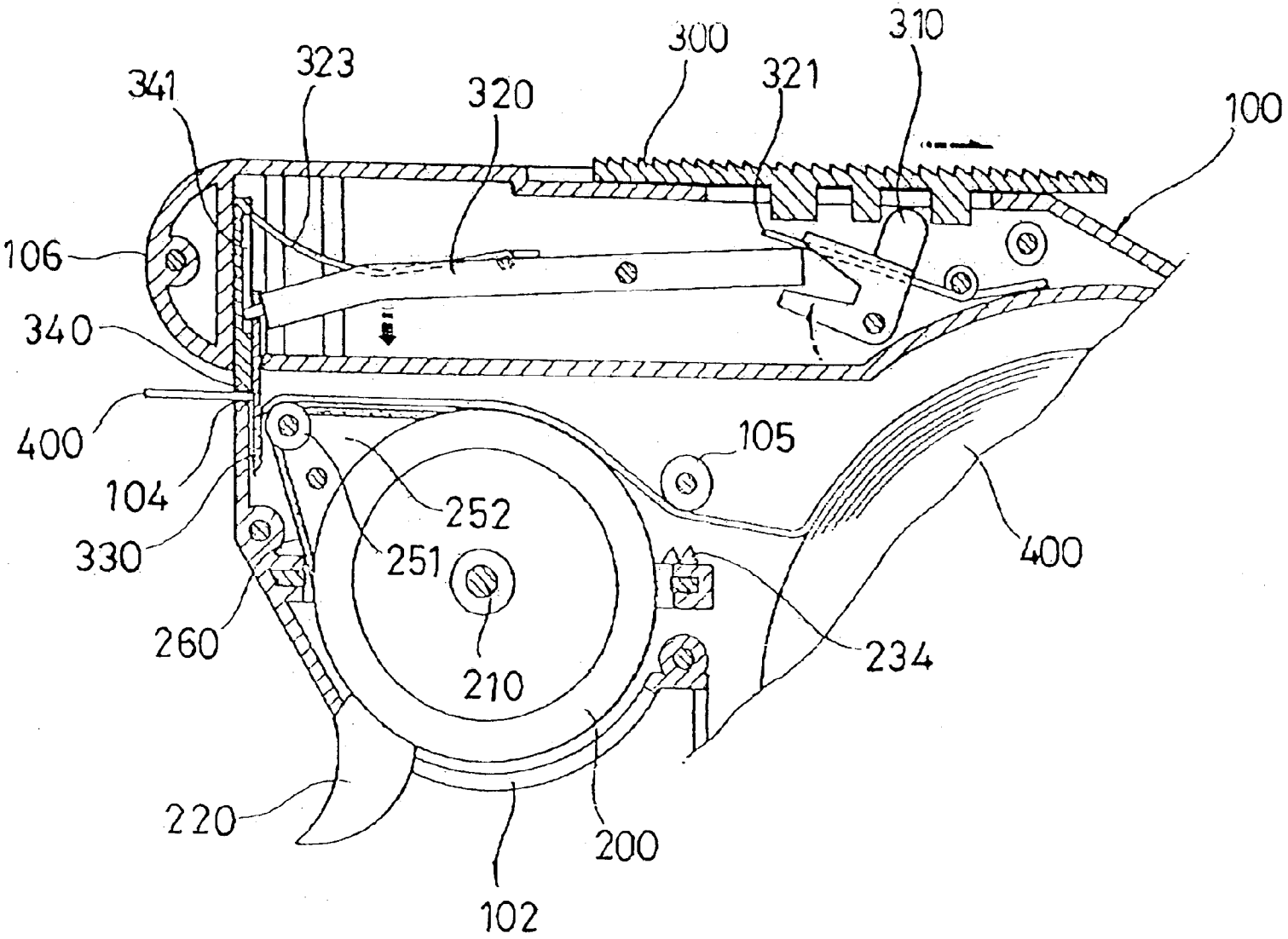

FIG. 6 is a perspective view showing the cutting means separated from the adhesive tape dispenser according to the present invention, FIG. 7 is a perspective view showing a disassembly of the cutting means according to the present invention, and FIG. 8*a* and FIG. 8*b* are explanation views of the operation principal of the cutting means according to the present invention.

Referring to FIG. 6 to FIG. 8, the construction of the cutting means according to the present invention is explained in more detail as follows.

Inside the gunbarrel portion of the case body 100, a lever 320 is mounted by a pin, and a rear part of the lever 320 is supported by a fourth spring 321. At the rear part of the gunbarrel portion, an end part of a movable latch 310 rotatably mounted by a pin is coupled. An upper part of the movable latch 310 is coupled to the handling member 300 slidably moved on the gunbarrel portion, so that when the handling member 300 is moved, the movable latch 310 may be moved rotatably.

The lever 320 has a pair of protrusions 322 at sides of a front end thereof, and an elastic steel wire 323 in inserted is the center of the lever 320.

The cutter 330 having a pair of holes 331 for inserting the protrusions 322 of the lever 320 and a pressing member 340 having a pair of guide grooves 341 for the protrusions 322 of the lever 320 is coupled with the lever 320, and a front end of the steel wire 323 is inserted in a hole of the push means 340 so that the cutter 330 and the push means 340 are movable up and down.

When cutting the adhesive tape 400, the push means 340 is lowered and pushes the adhesive tape 400 at the end part of the outlet 104 in order for the adhesive tape 400 not to move, and the cutter 330 is lowered and cuts the adhesive tape 400 between the end part of the outlet 104 of the case body 100 and the auxiliary rollers 251.

The gunbarrel portion has a rounded curved pressing portion 106 at the front end part thereof at which the cutting means is mounted. The pressing portion 106 may press the adhesive tape drawn through the outlet 104 of the case body 100 without touching the adhesive tape with band.

The unexplained reference number 107 and 108 are hinge pins by each of which the movable latch 310 and the lever 320 are mounted on the cutting means.

A process for inserting the adhesive tape in the adhesive tape dispenser according to the present invention will now be explained.

As shown in FIG. 1, the user separates the front end part of the roller adhesive tape 400 from the rolled adhesive tape 400, takes off the cover 110 from the case body 100, and inserts the adhesive the tape 400 into the case body 100. The front end of the adhesive tape 400 passes through the guide bar 105, the drums 200, the roller 240, and the auxiliary roller 251, and is inserted in the outlet 104 in order to be exposed outwardly. At this time, the adhesive surface of the adhesive tape is contacted to the surface of the drum 200, the roller 240, and the auxiliary roller 251. The cover 110 covers the case body 100.

A process for drawing the adhesive tape from the case body 100 will now be explained.

The user grasps the case body 100 with hand and pulls the trigger handle 220 exposed through the groove 102, of the case body 100 by the user's finger. When the trigger handle 220 is pulled, the first spring supporting the trigger handle 220 is compressed, so that the trigger handle 220 rotates on the shaft pin 210.

The push latch 222 which has a front end engaged with one of teeth of the latch gear of the inner periphery of the drum 200 is rotated with the trigger handle 220 and pushes the drum 200 so that the drums 200 rotate in the counterclockwise direction.

When the drums 200 rotate as the above, the adhesive tape adhered to the surface of the drums 200 is pulled and the rolled adhesive tape inserted in the protrusion 101 of the case body 100 is rotated.

At this time, the roller 240 mounted at the supporting portion 230 by a pin to be located on the upper side of the drum 200 idles and pulls the adhesive tape 400 to be drawn smoothly.

When the drums 200 rotate as the above, the auxiliary rollers 251 connected with the drums 200 by the belts 260 also rotate to hold the adhesive surface of the adhesive tape 400. The outer peripheries of the auxiliary rollers 251 are formed as a gear, such that the adhesive tape 400 may be smoothly drawn through the outlet 104, since the auxiliary roller 251 has a small contact area to the adhesive surface of the adhesive tape 400.

When the drums 200 rotate in the counterclockwise direction, the holding latch 232 rotates pressing the third spring 233 to release the latch gear 201 of the drums 200, so that the drums 200 can rotate freely.

If the user releases the pulled trigger handle 220, the push latch 222 is loosed from the latch gear 201 of the drum 200, since the first spring 221 has a tension higher than the second spring 223 supporting the push latch 222, and the trigger handle 220 is recovered to its original position.

The drums 200 are held by the holding latch 232 by the tension of the third spring 233 so as to keep the rotated position.

Therefore, the drums 200 are rotated so much as the number of times that the trigger handle 220 is pulled. By the process as the above, the user can draw out the adhesive tape 400 from the case body 100 as long as necessary without pulling it with hand.

As the user uses the rolled adhesive tape 400, it becomes smaller and smaller. Therefore, when the adhesive tape 400 passes through the guide bar 105, the adhesive surface of the adhesive tape 400 is adhered to the rear surface of the supporting portion 230, and thus the adhesive tape is not drawn well in spite of pulling the trigger handle 220.

However, the adhesive tape dispenser according to the present invention may prevent the adhesive surface of the adhesive tape 400 from contacting to the rear surface of the supporting portion 230 by the saw-toothed protrusion 234 thereof, so that the adhesive tape can be drawn well, though becoming smaller.

A process for cutting the adhesive tape in the adhesive tape dispenser according to the present invention will now be explained.

If the user wants to cut the adhesive tape 400 drawn from the case body 100 as long as necessary, the user pulls the handling member 300 mounted on the upper part of the case body 100 with the user's finger. As shown in FIG. 8*a*, as the movable latch 310 rotates on the hinge pin, the rear part of the lever 320 is lifted up and the front part thereof is lowered. The cutter 330 connected to the front end of the lever 320 is lowered and the pressing member 340 is also lowered by pressure of the steel wire 323 of the lever 320.

The pressing member 340 presses the upper part of the adhesive tape 400 drawn through the outlet 104 and is not lowered any longer. However, the cutter 330 can be more lowered, since the protrusion 322 of the lever 320 inserted in the holes 331 of the cutter 330 are moved down along with the guide groove 341 of the pressing member 340. As shown in FIG. 8*b*, as the steel wire 323 inserted in the pressing member 340 is bent by its elasticity, the cutter 330 is lowered with the lever 320, so as to cut the adhesive tape 400.

As described the above, the cutter 330 can cut clean, since the pressing member 340 press steadily the front part of the adhesive tape 400.

After cutting the adhesive tape 400, if the user releases the pulled handling member 300, the rear part of the lever 320 is recovered to its original position by a tension of the fourth spring 321, so that the handling member 300 is naturally recovered to its original position by the movable latch 310 which is rotated in the counterclockwise direction. The cutter 330 and the pressing member 340 connected at the front end of the lever 320 are also promptly lifted up to their original position so that the adhesive tape dispenser is in good state to cut the adhesive tape again.

As described hereinabove, the cut end of the adhesive tape 400 is adhered at the end part of the outlet 104. Therefore, by using the adhesive tape dispenser according to the present invention, the user puts and presses lightly the adhesive tape adhered to the end part of the outlet 104 on the things to stick the adhesive tape. Therefore, the adhesive strength of the adhesive tape 400 is not weak.

If the user wants the adhesive tape 400 to be drawn more longer, after drawing the adhesive tape 400 so long that it is contacted to the pressing portion 106 of the case body 100, the user puts the front end of the drawn adhesive tape 400 on the materials and presses it by using the rounded curved pressing portion 106 of the case body 100, and then the front end of the adhesive tape 400 is adhered on the things.

When the case body 100 is moved while the pressing portion 106 of the case body 100 presses the drawn adhesive tape as described above, the rolled adhesive tape 400 inserted in the case body 100 is continuously drawn even though the user does not pull the trigger handle 220, and the adhesive tape 400 is adhered on the things to stick the adhesive tape.

When the user pulls the handling member 300 with the user's finger after the adhesive tape is adhered as long as the user desires, the cutter is lowered and cuts the adhesive tape 400, so that the adhesive strength of the adhesive tape 400 is kept well and the user may use the adhesive tape conveniently.

Although the present invention has been described with reference to preferred embodiments, it will be apparent to one skilled in the art that variations may be made thereto without departing from the scope of the invention as claimed hereinafter.

What is claimed is:

1. An adhesive tape dispenser comprising:

a gun-shaped case body having a detachable cover, an outlet for drawing out an adhesive tape, at least one groove at one side of the case body, and a pair of holes at each side of the case body;

a drawing means for drawing an adhesive tape from the case body, the drawing means having a pair of drums and a trigger handle protruded outwardly through the groove of the case body, the trigger handle having a push latch mounted in a lower position from a center part of the pair of drums by a pin, a first spring supporting the triggering handle at the drums and a second spring supporting the push latch at the trigger handle, and the drums rotated with the trigger handle, each of the drums having multistage teeth on an inner periphery thereof, belts for rotating the tape to said outlet and a groove for each one of said belts on outer periphery thereof, and, a cutting means for cutting the adhesive tape which is drawn by the drawing means from the case body, the cutting means having a handling member mounted on a gunbarrel portion of the case body, a lever interlocking with the handling member and having a pair of protrusions at a front end thereof, and a cutter being mounted at a front end of the lever and having a pair of holes for inserting the protrusions of the lever.

2. An adhesive tape dispenser according to claim 1, wherein the drawing means further includes a supporting portion for supporting the drums having a pair of insertion portions which are located at side ends of the supporting portion, the insertion portions exposed outside the drums and fixedly inserted in the at least one groove of the case body and a holding latch supported by a third spring and mounted by a pin in opposing direction to the push latch, the holding latch and the push latch being engaged with the teeth of the drums when the drums are rotated; a roller for holding the adhesive tape, mounted at a front end of an upper part of the supporting portion by a pin to idle; a shaft pin for inserting the trigger handle and the supporting portion, the trigger handle being rotatable; a shaft having auxiliary rollers for holding the adhesive tape; and belts for connecting the shaft with the drums.

3. An adhesive tape dispenser according to claim 2, wherein the supporting portion has a saw-toothed protrusion at a rear part thereof, so that when the adhesive tape is drawn out while a diameter of the rolled adhesive tape becomes smaller, the adhesive surface of the adhesive tape is not contacted to the rear part of the supporting portion.

4. An adhesive tape dispenser according to claim 2, wherein each of the auxiliary rollers has an outer periphery formed as a gear to minimize a contact area of the adhesive surface of the adhesive tape.

5. An adhesive tape dispenser according to claim 1, wherein the cutting means further includes a movable latch having a hole for inserting the lever, the movable latch in which the lever is inserted being supported by a fourth spring and being moved along with the handling member moving slidingly on the upper part of the gunbarrel portion; an elastic steel wire being protruded upward from the cutter through a hole of the lever; and a pressing member connected to the lever by the elastic steel wire, wherein when the handling member is pulled backwardly, the pressing member is lowered with the cutter and presses the end part of the adhesive tape on the end part of the outlet of the case body before cutting the adhesive tape by the cutter.

6. An adhesive tape dispenser according to claim 1, the gunbarrel portion has a rounded curved pressing portion at a front end thereof so that a user may press the front end of the adhesive tape on things to stick the adhesive tape without using the user's hand.

* * * * *